US009366162B1

(12) United States Patent
Haltiner, Jr. et al.

(10) Patent No.: US 9,366,162 B1
(45) Date of Patent: Jun. 14, 2016

(54) CAMSHAFT PHASER WITH POSITION CONTROL VALVE

(71) Applicant: DELPHI TECHNOLOGIES, INC., Troy, MI (US)

(72) Inventors: Karl J. Haltiner, Jr., Fairport, NY (US); Thomas H. Lichti, Victor, NY (US)

(73) Assignee: Delphi Technologies, Inc., Troy, MI (US)

( * ) Notice: Subject to any disclaimer, the term of this patent is extended or adjusted under 35 U.S.C. 154(b) by 14 days.

(21) Appl. No.: 14/554,400

(22) Filed: Nov. 26, 2014

(51) Int. Cl.
*F01L 1/34* (2006.01)
*F01L 1/344* (2006.01)
*F04C 2/344* (2006.01)

(52) U.S. Cl.
CPC ..... *F01L 1/3442* (2013.01); *F04C 2/3448* (2013.01); *F01L 2001/34426* (2013.01)

(58) Field of Classification Search
CPC ..... F01L 1/3442; F01L 2001/34426; F04C 2/3448
USPC ..... 123/90.17
See application file for complete search history.

(56) References Cited

U.S. PATENT DOCUMENTS

| | | | | |
|---|---|---|---|---|
| 5,507,254 | A | 4/1996 | Melchior | |
| 5,645,017 | A | 7/1997 | Melchior | |
| 5,649,506 | A | 7/1997 | Melchior | |
| 7,523,728 | B2 | 4/2009 | Berndorfer | |
| 8,156,906 | B2 * | 4/2012 | Takenaka | F01L 1/022 123/90.15 |
| 8,534,246 | B2 | 9/2013 | Lichti et al. | |
| 2007/0017463 | A1 | 1/2007 | Mott et al. | |

FOREIGN PATENT DOCUMENTS

| | | | |
|---|---|---|---|
| GB | 2487227 | A | 7/2012 |

* cited by examiner

*Primary Examiner* — Zelalem Eshete
(74) *Attorney, Agent, or Firm* — Joshua M. Haines

(57) ABSTRACT

A camshaft phaser includes an input member; an output member defining an advance chamber and a retard chamber with the input member; a valve spool coaxially disposed within the output member such that the valve spool is rotatable relative to the output member and the input member, the valve spool defining a supply chamber and a vent chamber with the output member; an actuator which rotates the valve spool in order to change the position of the output member relative to the input member by supplying pressurized oil from the supply chamber to one of the advance chamber and the retard chamber and venting oil to the vent chamber from the other of the supply chamber and the advance chamber; and a check valve which allows oil to flow from the vent chamber to the supply chamber and prevents oil from flowing from the supply chamber to the vent chamber.

19 Claims, 16 Drawing Sheets

CAMSHAFT PHASER WITH POSITION CONTROL VALVE

TECHNICAL FIELD OF INVENTION

The present invention relates to a camshaft phaser for varying the phase relationship between a crankshaft and a camshaft in an internal combustion engine; more particularly to such a camshaft phaser which is a vane-type camshaft phaser; even more particularly to a vane-type camshaft phaser which includes a control valve in which the position of the control valve determines the phase relationship between the crankshaft and the camshaft; and still even more particularly to such a camshaft phaser which uses torque reversals of the camshaft to actuate the camshaft phaser.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance chambers and retard chambers by a phasing oil control valve in order to rotate the rotor within the stator and thereby change the phase relationship between the camshaft and the crankshaft. One such camshaft phaser is described in U.S. Pat. No. 8,534,246 to Lichti et al., the disclosure of which is incorporated herein by reference in its entirety and hereinafter referred to as Lichti et al. As is typical for phasing oil control valves, the phasing oil control valve of Lichti et al. operates on the principle of direction control, i.e. the position of the oil control valve determines the direction of rotation of the rotor relative to the stator. More specifically, when a desired phase relationship between the camshaft and the crankshaft is determined, the desired phase relationship is compared to the actual phase relationship as determined from the outputs of a camshaft position sensor and a crankshaft position sensor. If the actual phase relationship, does not match the desired phase relationship, the oil control valve is actuated to either 1) an advance position to supply oil to the retard chambers and vent oil from the advance chambers or 2) a retard position to supply oil to the advance chambers and vent oil from the retard chambers until the actual phase relationship matches the desired phase relationship. When the actual phase relationship matches the desired phase relationship, the oil control valve is positioned to hydraulically lock the rotor relative to the stator. However, leakage from the advance chambers and the retard chambers or leakage from the oil control valve may cause the phase relationship to drift over time. When the drift in phase relationship is detected by comparing the actual phase relationship to the desired phase relationship, the oil control valve must again be actuated to either the advance position or the retard position in order to correct for the drift, then the oil control valve is again positioned to hydraulically lock the rotor relative to the stator after the correction has been made. Consequently, the position of the rotor relative to the stator is not self-correcting and relies upon actuation of the phasing oil control valve to correct for the drift.

U.S. Pat. No. 5,507,254 to Melchior, hereinafter referred to as Melchior, teaches a camshaft phaser with a phasing oil control valve which allows for self-correction of the rotor relative to the stator as may be necessary due to leakage from the advance chamber or from the retard chamber. Melchior also teaches that the valve spool defines a first recess and a second recess separated by a rib such that one of the recesses acts to supply oil to the advance chamber when a retard in timing of the camshaft is desired while the other recess acts to supply oil to the retard chamber when an advance in the timing of the camshaft is desired. The recess that does not act to supply oil when a change in phase is desired does not act as a flow path. However, improvements are always sought in any art.

What is needed is a camshaft phaser which minimizes or eliminates one or more the shortcomings as set forth above.

SUMMARY OF THE INVENTION

Briefly described, a camshaft phaser is provided for use with an internal combustion engine for controllably varying the phase relationship between a crankshaft and a camshaft in the internal combustion engine. The camshaft phaser includes an input member connectable to the crankshaft of the internal combustion engine to provide a fixed ratio of rotation between the input member and the crankshaft; an output member connectable to the camshaft of the internal combustion engine and defining an advance chamber and a retard chamber with the input member; a valve spool coaxially disposed within the output member such that the valve spool is rotatable relative to the output member and the input member, the valve spool defining a supply chamber and a vent chamber with the output member; an actuator which rotates the valve spool in order to change the position of the output member relative to the input member by 1) supplying oil from the supply chamber to the advance chamber and venting oil from the retard chamber to the vent chamber when retarding the phase relationship of the camshaft relative to the crankshaft is desired and 2) supplying oil from the supply chamber to the retard chamber and venting oil from the advance chamber to the vent chamber when advancing the phase relationship between the camshaft relative to the crankshaft is desired; and a phasing check valve which allows oil to flow from the vent chamber to the supply chamber and prevents oil from flowing from the supply chamber to the vent chamber.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
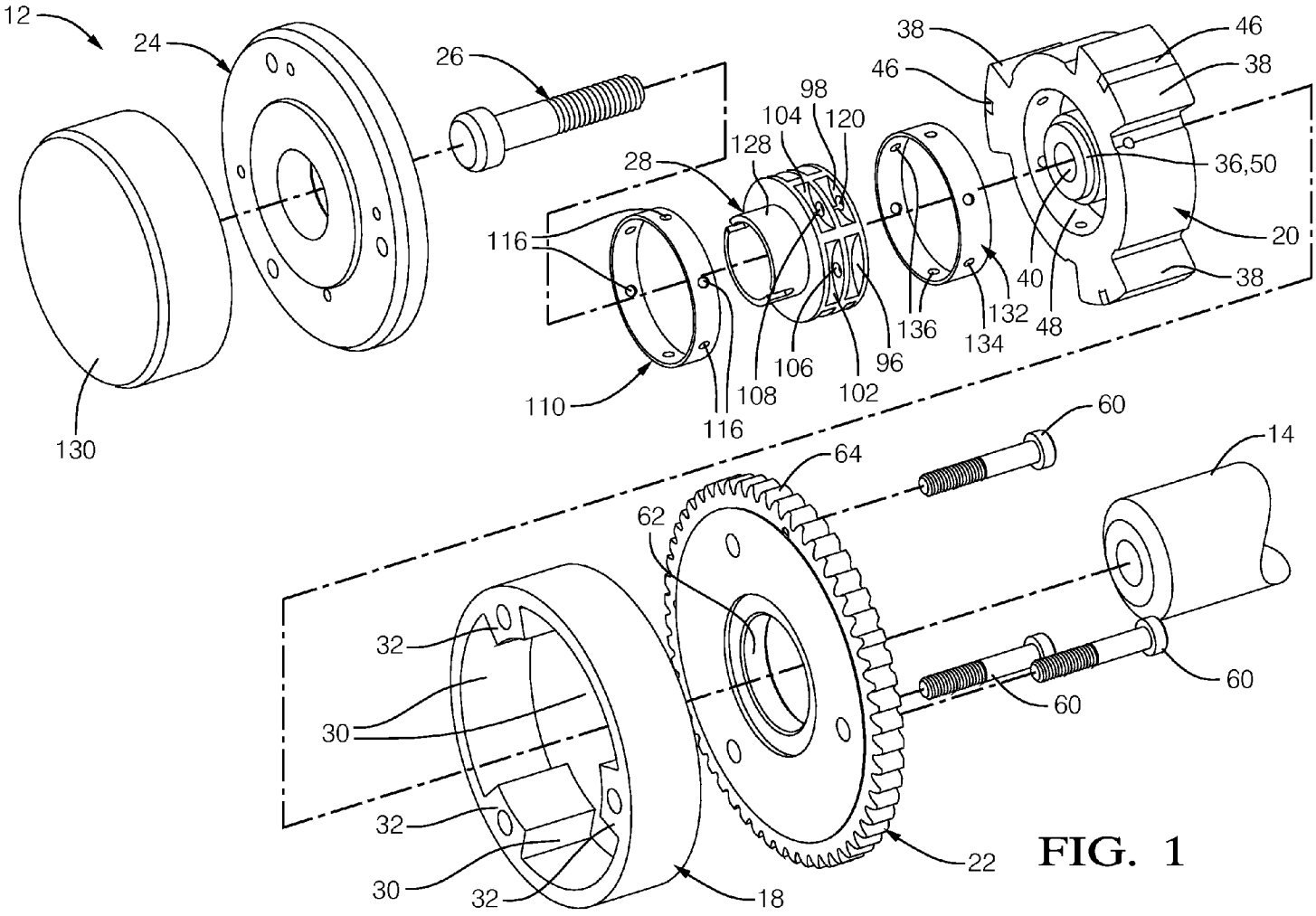
FIG. 1 is an exploded isometric view of a camshaft phaser in accordance with the present invention.
Figure 2:
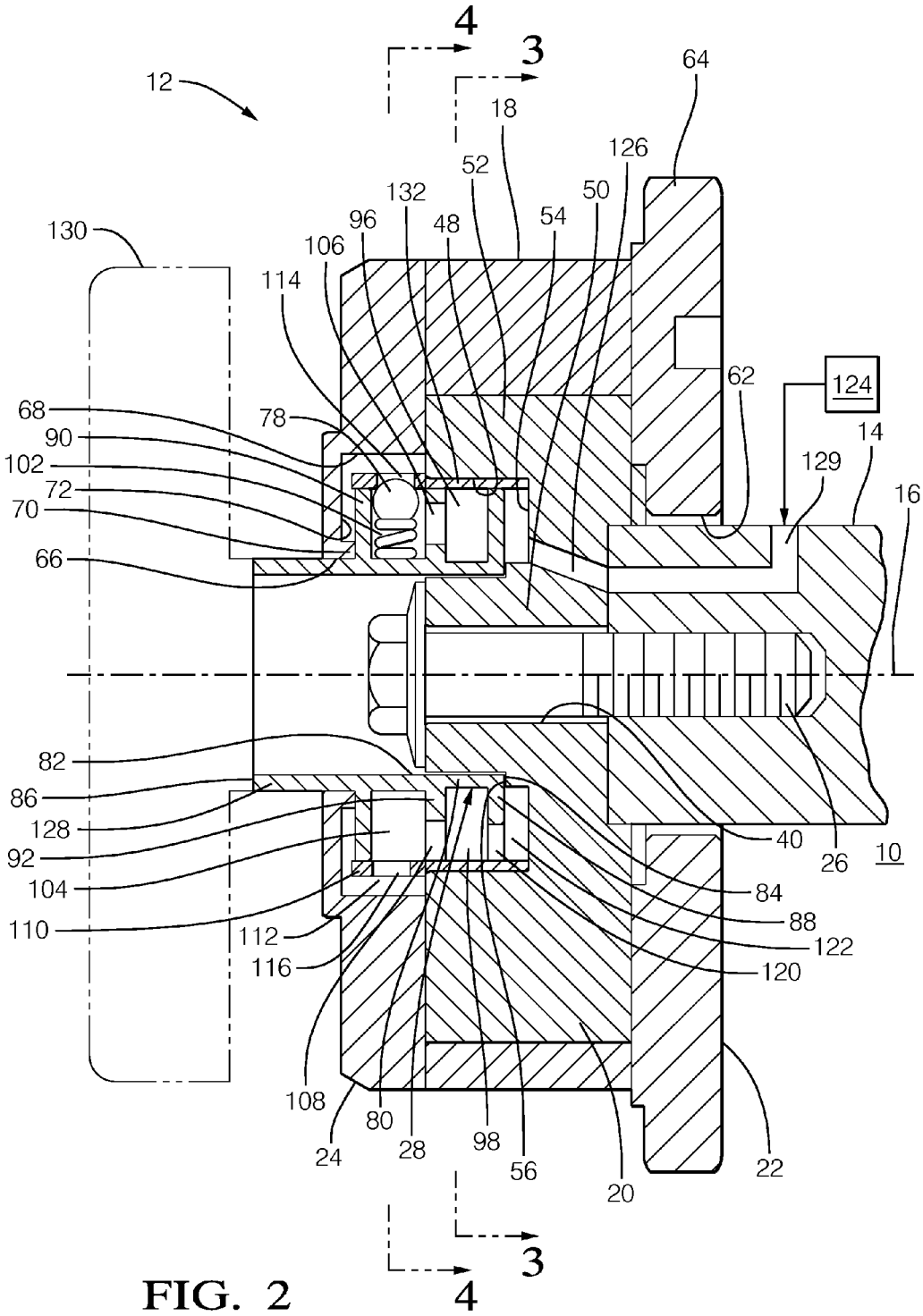
FIG. 2 is an axial cross-section view of the camshaft phaser of FIG. 1.

In accordance with a preferred embodiment of this invention and referring to FIGS. 1-4, an internal combustion engine 10 is shown which includes a camshaft phaser 12. Internal combustion engine 10 also includes a camshaft 14 which is rotatable about a camshaft axis 16 based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing or phase between the crankshaft and camshaft 14 to be varied. In this way, opening and closing of the intake and/or exhaust valves can be advanced or retarded in order to achieve desired engine performance.

Camshaft phaser 12 generally includes a stator 18 which acts as an input member, a rotor 20 disposed coaxially within stator 18 which acts as an output member, a back cover 22 closing off one axial end of stator 18, a front cover 24 closing off the other axial end of stator 18, a camshaft phaser attachment bolt 26 for attaching camshaft phaser 12 to camshaft 14, and a valve spool 28. The rotational position of valve spool 28 relative to stator 18 determines the rotational position of rotor 20 relative to stator 18, unlike typical valve spools which move axially to determine only the direction the rotor will rotate relative to the stator. The various elements of camshaft phaser 12 will be described in greater detail in the paragraphs that follow.

Stator 18 is generally cylindrical and includes a plurality of radial chambers 30 defined by a plurality of lobes 32 extending radially inward. In the embodiment shown, there are three lobes 32 defining three radial chambers 30, however, it is to be understood that a different number of lobes 32 may be provided to define radial chambers 30 equal in quantity to the number of lobes 32.

Rotor 20 includes a rotor central hub 36 with a plurality of vanes 38 extending radially outward therefrom and a rotor central through bore 40 extending axially therethrough. The number of vanes 38 is equal to the number of radial chambers 30 provided in stator 18. Rotor 20 is coaxially disposed within stator 18 such that each vane 38 divides each radial chamber 30 into advance chambers 42 and retard chambers 44. The radial tips of lobes 32 are mateable with rotor central hub 36 in order to separate radial chambers 30 from each other. Each of the radial tips of vanes 38 may include one of a plurality of wiper seals 46 to substantially seal adjacent advance chambers 42 and retard chambers 44 from each other. While not shown, each of the radial tips of lobes 32 may also include one of a plurality of wiper seals 46.

Rotor central hub 36 defines an annular valve spool recess 48 which extends part way into rotor central hub 36 from the axial end of rotor central hub 36 that is proximal to front cover 24. As a result, rotor central hub 36 includes a rotor central hub inner portion 50 that is annular in shape and bounded radially inward by rotor central through bore 40 and bounded radially outward by annular valve spool recess 48. Also as a result, rotor central hub 36 includes a rotor central hub outer portion 52 that is bounded radially inward by annular valve spool recess 48 and is bounded radially outward by the radially outward portion of rotor central hub outer portion 52 from which lobes 32 extend radially outward. Since annular valve spool recess 48 extends only part way into rotor central hub 36, annular valve spool recess 48 defines an annular valve spool recess bottom 54 which is annular in shape and extends between rotor central hub inner portion 50 and rotor central hub outer portion 52. As shown, annular valve spool recess bottom 54 may be stepped, thereby defining a valve spool recess shoulder 56 that is substantially perpendicular to camshaft axis 16.

Back cover 22 is sealingly secured, using cover bolts 60, to the axial end of stator 18 that is proximal to camshaft 14. Tightening of cover bolts 60 prevents relative rotation between back cover 22 and stator 18. Back cover 22 includes a back cover central bore 62 extending coaxially therethrough. The end of camshaft 14 is received coaxially within back cover central bore 62 such that camshaft 14 is allowed to rotate relative to back cover 22. Back cover 22 may also include a sprocket 64 formed integrally therewith or otherwise fixed thereto. Sprocket 64 is configured to be driven by a chain that is driven by the crankshaft of internal combustion engine 10. Alternatively, sprocket 64 may be a pulley driven by a belt or other any other known drive member known for driving camshaft phaser 12 by the crankshaft. In an alternative arrangement, sprocket 64 may be integrally formed or otherwise attached to stator 18 rather than back cover 22.

Similarly, front cover 24 is sealingly secured, using cover bolts 60, to the axial end of stator 18 that is opposite back cover 22. Cover bolts 60 pass through back cover 22 and stator 18 and threadably engage front cover 24; thereby clamping stator 18 between back cover 22 and front cover 24 to prevent relative rotation between stator 18, back cover 22, and front cover 24. In this way, advance chambers 42 and retard chambers 44 are defined axially between back cover 22 and front cover 24. Front cover 24 includes a front cover central bore 66 extending coaxially therethrough and a front cover counter bore 68 extending coaxially thereinto from the side of front cover 24 which is adjacent to stator 18. A front cover annular projection 70 extends axially from the bottom of front cover counter bore 68 toward rotor 20 such that front cover annular projection 70 in parts defines front cover central bore 66 and such that front cover annular projection 70 defines, together with front cover counter bore 68, a front cover annular recess 72.

Camshaft phaser 12 is attached to camshaft 14 with camshaft phaser attachment bolt 26 which extends coaxially through rotor central through bore 40 of rotor 20 and threadably engages camshaft 14, thereby by clamping rotor 20 securely to camshaft 14. More specifically, rotor central hub inner portion 50 is clamped between the head of camshaft phaser attachment bolt 26 and camshaft 14. In this way, relative rotation between stator 18 and rotor 20 results in a change in phase or timing between the crankshaft of internal combustion engine 10 and camshaft 14.

Oil is selectively transferred to advance chambers 42 from retard chambers 44, as result of torque applied to camshaft 14 from the valve train of internal combustion engine 10, i.e. torque reversals of camshaft 14, in order to cause relative rotation between stator 18 and rotor 20 which results in retarding the timing of camshaft 14 relative to the crankshaft of internal combustion engine 10. Conversely, oil is selectively transferred to retard chambers 44 from advance chambers 42, as result of torque applied to camshaft 14 from the valve train of internal combustion engine 10, in order to cause relative rotation between stator 18 and rotor 20 which results in advancing the timing of camshaft 14 relative to the crankshaft of internal combustion engine 10. Rotor advance passages 74 may be provided in rotor 20 for supplying and venting oil to and from advance chambers 42 while rotor retard passages 76 may be provided in rotor 20 for supplying and venting oil to and from retard chambers 44. Rotor advance passages 74 extend radially outward through rotor central hub outer portion 52 from annular valve spool recess 48 to advance chambers 42 while rotor retard passages 76 extend radially outward through rotor central hub outer portion 52 from annular valve spool recess 48 to retard chambers 44. Transferring oil to advance chambers 42 from retard chambers 44 and transferring oil to retard chambers 44 from advance chambers 42 is controlled by valve spool 28 and phasing check valves 78, as will be described in detail later, such that valve spool 28 is disposed coaxially and rotatably within annular valve spool recess 48. It should be noted that phasing check valves 78 are shown in FIGS. 4, 5B, 5F, 6B, 6F in simplified schematic form in dotted lines in order to allow viewing of oil passages in valve spool 28.

Rotor 20 and valve spool 28, which act together to function as a valve, will now be described in greater detail with continued reference to FIGS. 1-4. Valve spool 28 includes a spool central hub 80 with a spool central through bore 82 extending coaxially therethrough. Valve spool 28 is received coaxially within annular valve spool recess 48, and consequently, valve spool 28 radially surrounds camshaft phaser attachment bolt 26. Spool central through bore 82 is sized to mate with rotor central hub inner portion 50 in a close sliding interface such that valve spool 28 is able to freely rotate on rotor central hub inner portion 50 while substantially preventing oil from passing between the interface of spool central through bore 82 and rotor central hub inner portion 50 and also substantially preventing radial movement of valve spool 28 within annular valve spool recess 48. Spool central hub 80 extends axially from a spool hub first end 84 which is proximal to rotor 20 to a spool hub second end 86 which is distal from rotor 20. Valve spool 28 also includes an annular spool base 88 which extends radially outward from spool central hub 80 at spool hub first end 84 such that annular spool base 88 axially abuts valve spool recess shoulder 56. Valve spool 28 also includes an annular spool top 90 which extends radially outward from spool central hub 80 such that annular spool top 90 axially abuts front cover annular projection 70 of front cover 24 and such that annular spool top 90 is axially spaced from annular spool base 88. Consequently, annular spool base 88 and annular spool top 90 are captured axially between valve spool recess shoulder 56 and front cover 24 such that axial movement of valve spool 28 relative to rotor 20 is substantially prevented. Valve spool 28 also includes an annular spool dividing wall 92 which extends radially outward from spool central hub 80 such that annular spool dividing wall 92 is axially between annular spool base 88 and annular spool top 90. A plurality of valve spool inner lands 94 extend radially outward from spool central hub 80 in a polar array such that valve spool inner lands 94 join annular spool base 88 and annular spool dividing wall 92, thereby defining a plurality of alternating inner supply chambers 96 and inner vent chambers 98 between annular spool base 88 and annular spool dividing wall 92. The number of valve spool inner lands 94 is equal to the sum of the number of advance chambers 42 and the number of retard chambers 44, and as shown in the figures of the described embodiment, there are six valve spool inner lands 94. A plurality of valve spool outer lands 100 extend radially outward from spool central hub 80 in a polar array such that valve spool outer lands 100 join annular spool dividing wall 92 and annular spool top 90, thereby defining a plurality of alternating outer supply chambers 102 and outer vent chambers 104 between annular spool dividing wall 92 and annular spool top 90. The number of valve spool outer lands 100 is equal to the number of valve spool inner lands 94. Annular spool dividing wall 92 includes a plurality of supply chamber connecting passages 106 extend axially therethrough such that each supply chamber connecting passage 106 provides fluid communication between a respective inner supply chamber 96 and a respective outer supply chamber 102. Similarly, annular spool dividing wall 92 includes a plurality of vent chamber connecting passages 108 extend axially therethrough such that each vent chamber connecting passage 108 provides fluid communication between a respective inner vent chamber 98 and a respective outer vent chamber 104.

Valve spool 28 also includes a valve spool band 110 which radially surrounds outer supply chambers 102 and outer vent chambers 104 such that valve spool band 110 is sealingly secured to annular spool dividing wall 92 and annular spool top 90. A reservoir 112 is defined radially between valve spool band 110 and front cover counter bore 68 and also axially between annular spool top 90 and front cover 24. Valve spool band 110 includes a plurality of valve spool band supply passages 114 extending radially therethrough and a plurality of valve spool band vent passages 116 extending radially therethrough. Each valve spool band supply passage 114 provides fluid communication between a respective outer supply chamber 102 and reservoir 112 while each valve spool band vent passage 116 provides fluid communication between a respective outer vent chamber 104 and reservoir 112. Each valve spool band supply passage 114 includes a respective phasing check valve 78 which allows oil to flow from reservoir 112 to respective outer supply chambers 102 while preventing oil from flowing from outer supply chambers 102 to reservoir 112 as will be described in greater detail later.

Annular spool base 88 includes oil make-up passages 120 extending axially therethrough which provide fluid communication between respective inner vent chambers 98 and an annular volume 122 defined axially between annular valve spool recess bottom 54 and annular spool base 88. Annular volume 122 receives pressurized oil from an oil source 124, for example, an oil pump of internal combustion engine 10, via a rotor supply passage 126 formed in rotor 20 and also via a camshaft supply passage 129 formed in camshaft 14.

Valve spool 28 also includes a valve spool drive extension 128 which extends axially from annular spool top 90 and through front cover central bore 66. Valve spool drive extension 128 and front cover central bore 66 are sized to interface in a close sliding fit which permits valve spool 28 to rotate freely relative to front cover 24 while substantially preventing oil from passing between the interface of valve spool drive extension 128 and front cover central bore 66. Valve spool drive extension 128 is arranged to engage an actuator 130 which is used to rotate valve spool 28 relative to stator 18 and rotor 20 as required to achieve a desired rotational position of rotor 20 relative to stator 18 as will be described in greater detail later. Actuator 130 may be, by way of non-limiting example only, an electric motor which is stationary relative to camshaft phaser 12 and connected to valve spool drive extension 128 through a gear set or an electric motor which rotates with camshaft phaser 12 and which is powered through slip rings. Actuator 130 may be controlled by an electronic controller (not shown) based on inputs from various sensors (not shown) which may provide signals indicative of, by way of non-limiting example only, engine temperature, ambient temperature, intake air flow, manifold pressure, exhaust constituent composition, engine torque, engine speed, throttle position, crankshaft position, and camshaft position. Based on the inputs from the various sensors, the electronic controller may determine a desired phase relationship between the crankshaft and camshaft 14, thereby commanding actuator 130 to rotate valve spool 28 relative to stator 18 and rotor 20 as required to achieve the desired rotational position of rotor 20 relative to stator 18.

A valve spool ring 132 is located radially between valve spool 28 and the portion of annular valve spool recess 48 defined by rotor central hub outer portion 52. Valve spool ring 132 is fixed to rotor 20, for example only, by press fitting valve spool ring 132 with annular valve spool recess 48, such that relative rotation between valve spool ring 132 and rotor 20 is prevented. Valve spool ring 132 is sized to substantially prevent oil from passing between the interface between valve spool ring 132 and annular valve spool recess 48. Valve spool ring 132 includes a plurality of valve spool ring advance passages 134 and a plurality of valve spool ring retard passages 136 which extend radially therethrough. Each valve spool ring advance passage 134 is aligned with a respective rotor advance passage 74 while each valve spool ring retard passage 136 is aligned with a respective rotor retard passage 76. Each valve spool ring advance passage 134 and each valve spool ring retard passage 136 is sized to be equal to the width of valve spool inner lands 94, and the spacing between valve spool ring advance passages 134 and valve spool ring retard passages 136 matches the spacing between valve spool inner lands 94. Valve spool inner lands 94 engage the inner circumference of valve spool ring 132 to substantially prevent oil from passing between the interfaces of valve spool inner lands 94 and valve spool ring 132 while allowing valve spool 28 to rotate within valve spool ring 132 substantially uninhibited. Consequently, inner supply chambers 96 and inner vent chambers 98 are fluidly segregated and fluid communication into and out of advance chambers 42 and retard chambers 44 is substantially prevented when valve spool inner lands 94 are aligned with valve spool ring advance passages 134 and valve spool ring retard passages 136 to block valve spool ring advance passages 134 and valve spool ring retard passages 136.

Figure 3:
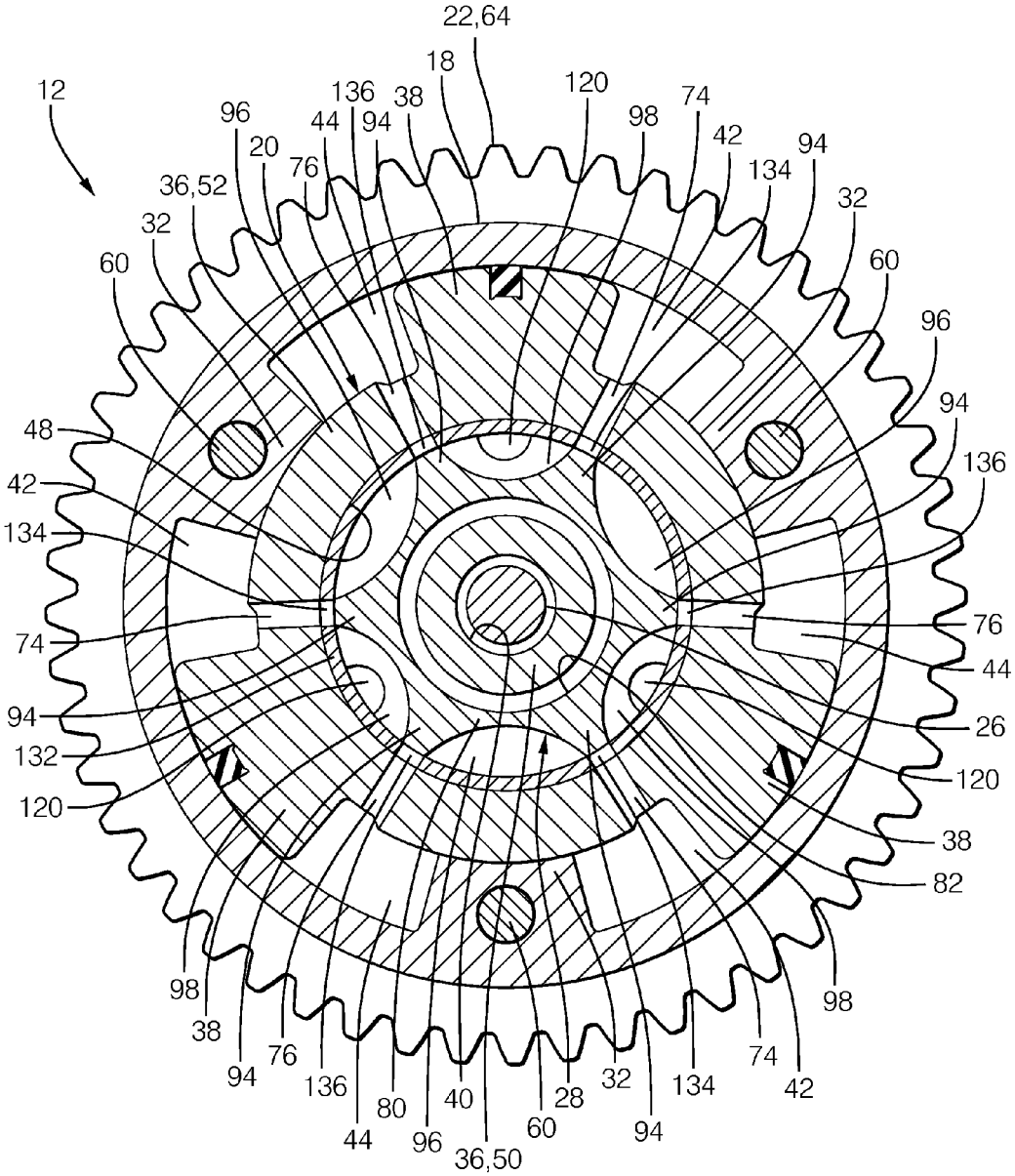
FIG. 3 is a radial cross-sectional view of the camshaft phaser taken through section line 3-3 of FIG. 2 and showing a valve spool of the camshaft phaser in a hold position which maintains a rotational position of a rotor of the camshaft phaser relative to a stator of the camshaft phaser.
Figure 4:
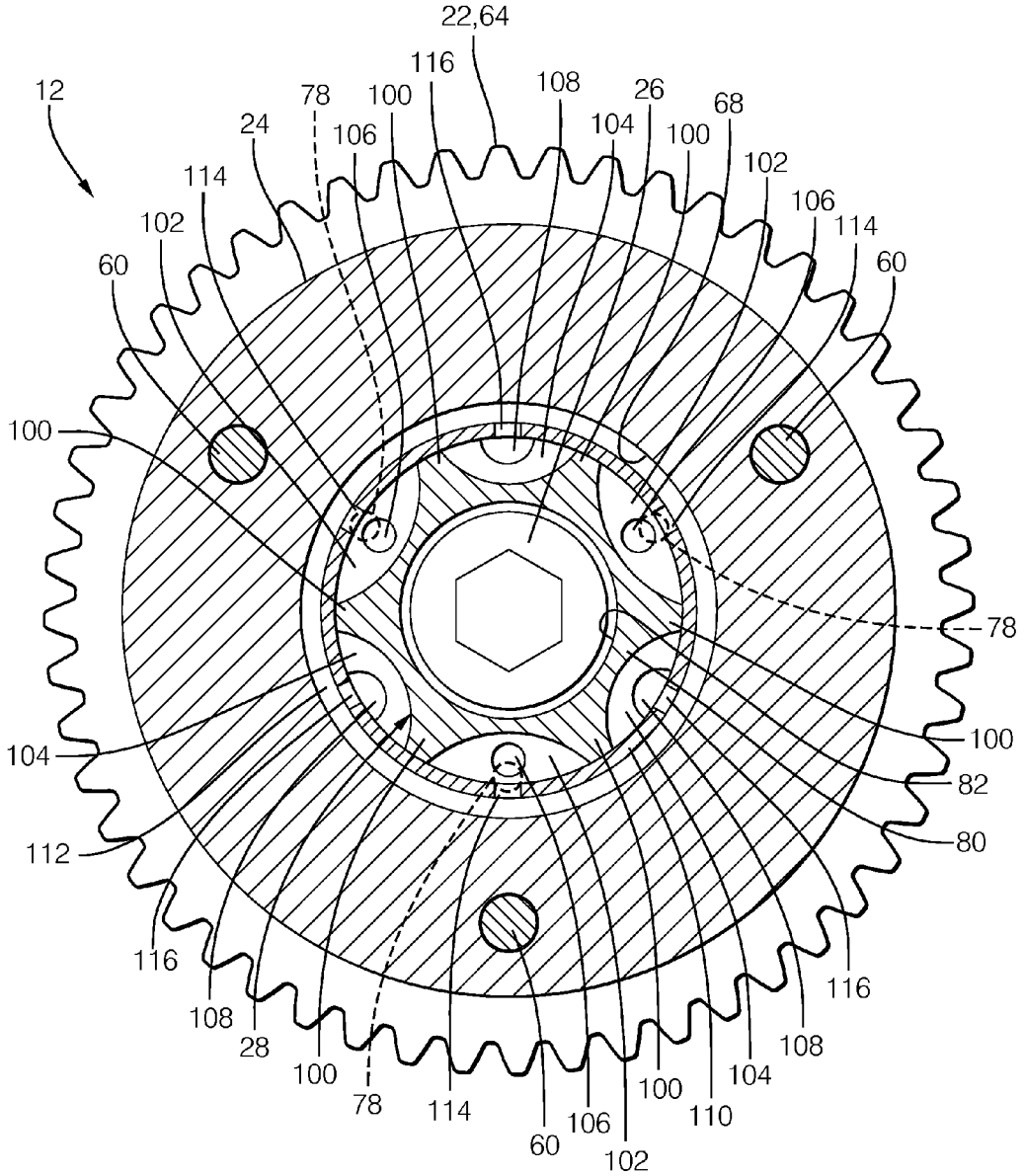
FIG. 4 is a radial cross-sectional view of the camshaft phaser taken through section line 4-4 of FIG. 2 and showing the valve spool of the camshaft phaser in a hold position which maintains a rotational position of the rotor relative to the stator.

Operation of camshaft phaser 12 will now be described with continued reference to FIGS. 1-4 and now with additional reference to FIGS. 5A-6F. The rotational position of rotor 20 relative to stator 18 is determined by the rotational position of valve spool 28 relative to stator 18. When the rotational position of rotor 20 relative to stator 18 is at a desired position to achieve desired operational performance of internal combustion engine 10, the rotational position of valve spool 28 relative to stator 18 is maintained constant by actuator 130. Consequently, a hold position as shown in FIGS. 3 and 4 is defined when each valve spool inner land 94 is aligned with a respective valve spool ring advance passage 134 or a respective valve spool ring retard passage 136, thereby preventing fluid communication into and out of advance chambers 42 and retard chambers 44 and hydraulically locking the rotational position of rotor 20 relative to stator 18. In this way, the phase relationship between camshaft 14 and the crankshaft is maintained.

Figure 5A:
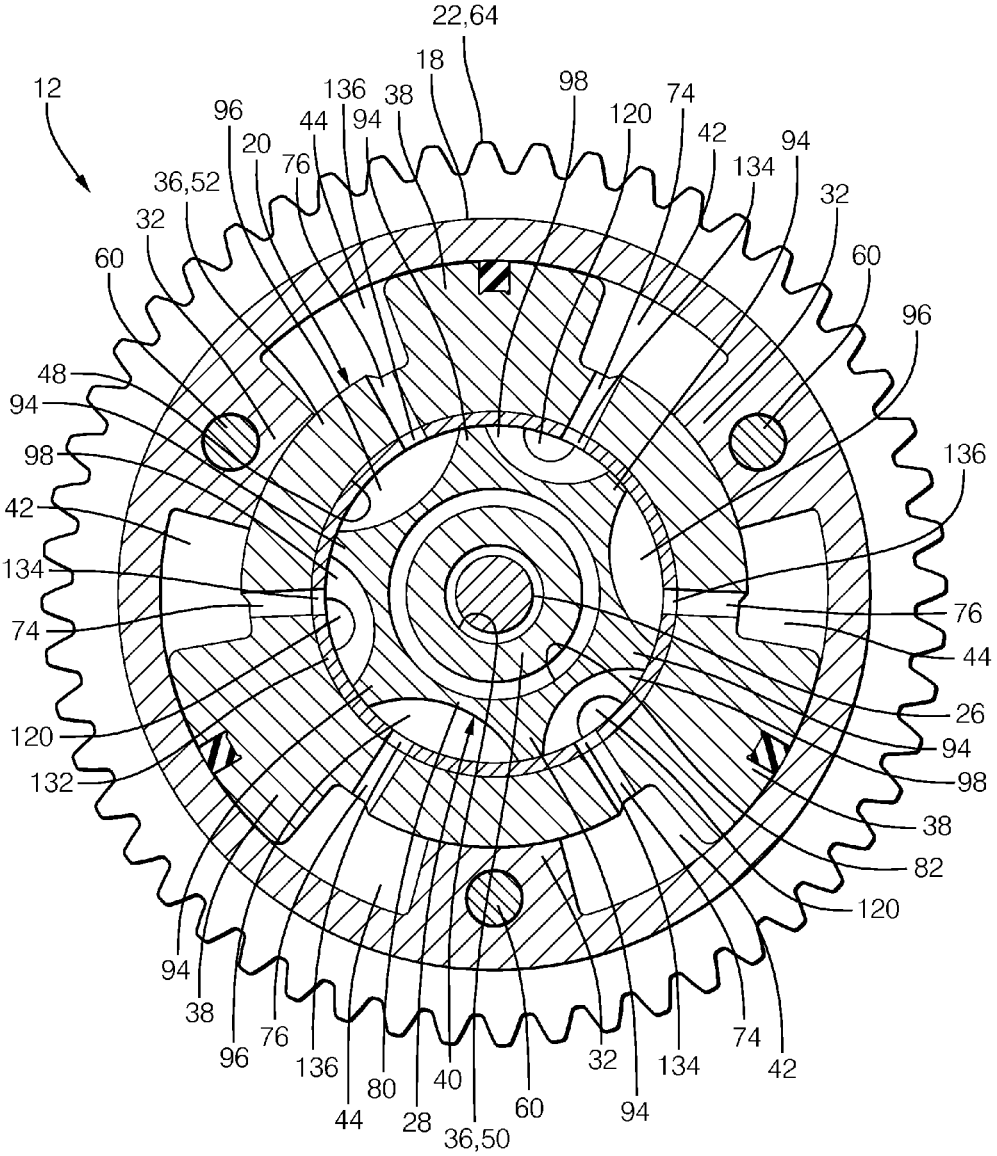
FIG. 5A is a radial cross-sectional view of the camshaft phaser taken through section line 3-3 of FIG. 2 showing the valve spool in a position which will result in a clockwise rotation of the rotor relative to the stator.
Figure 5B:
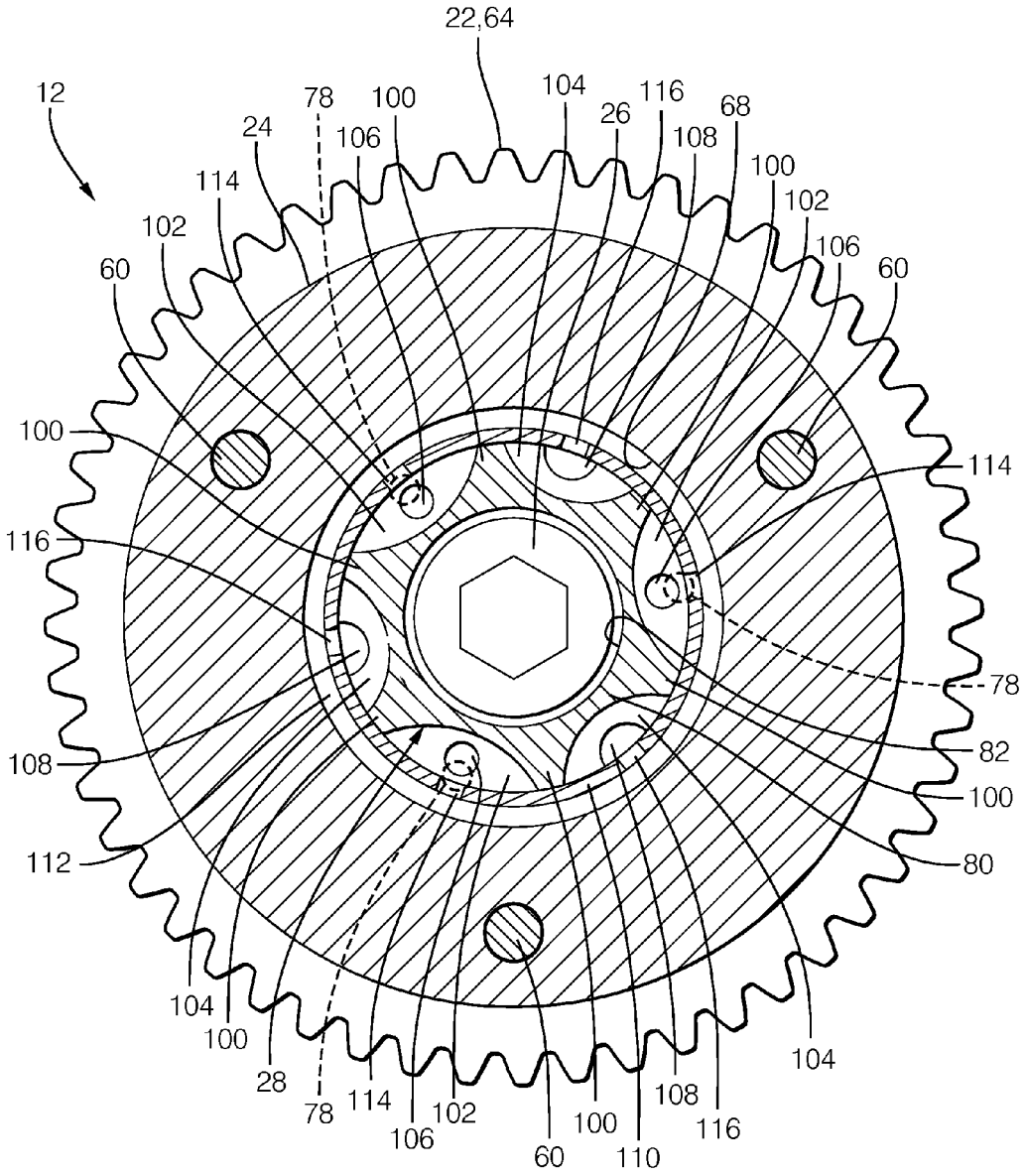
FIG. 5B is a radial cross-sectional view of the camshaft phaser taken through section line 4-4 of FIG. 2 showing the valve spool in the position of FIG. 5A.
Figure 5C:
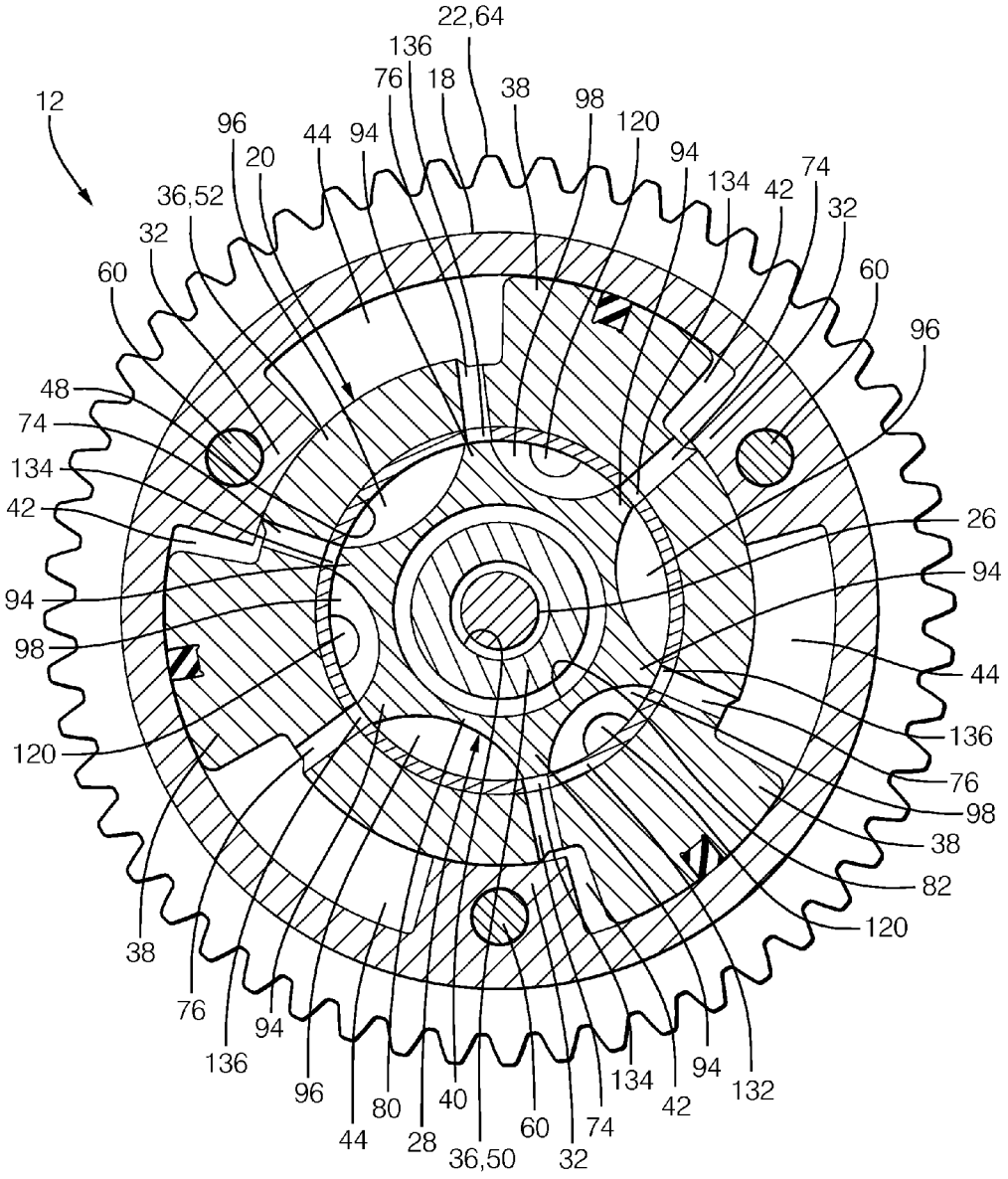
FIG. 5C is a radial cross-sectional view of the camshaft phaser taken through section line 3-3 of FIG. 2 showing the rotor after being rotated clockwise as a result of the position of the valve spool as shown in FIG. 5A.
Figure 5D:
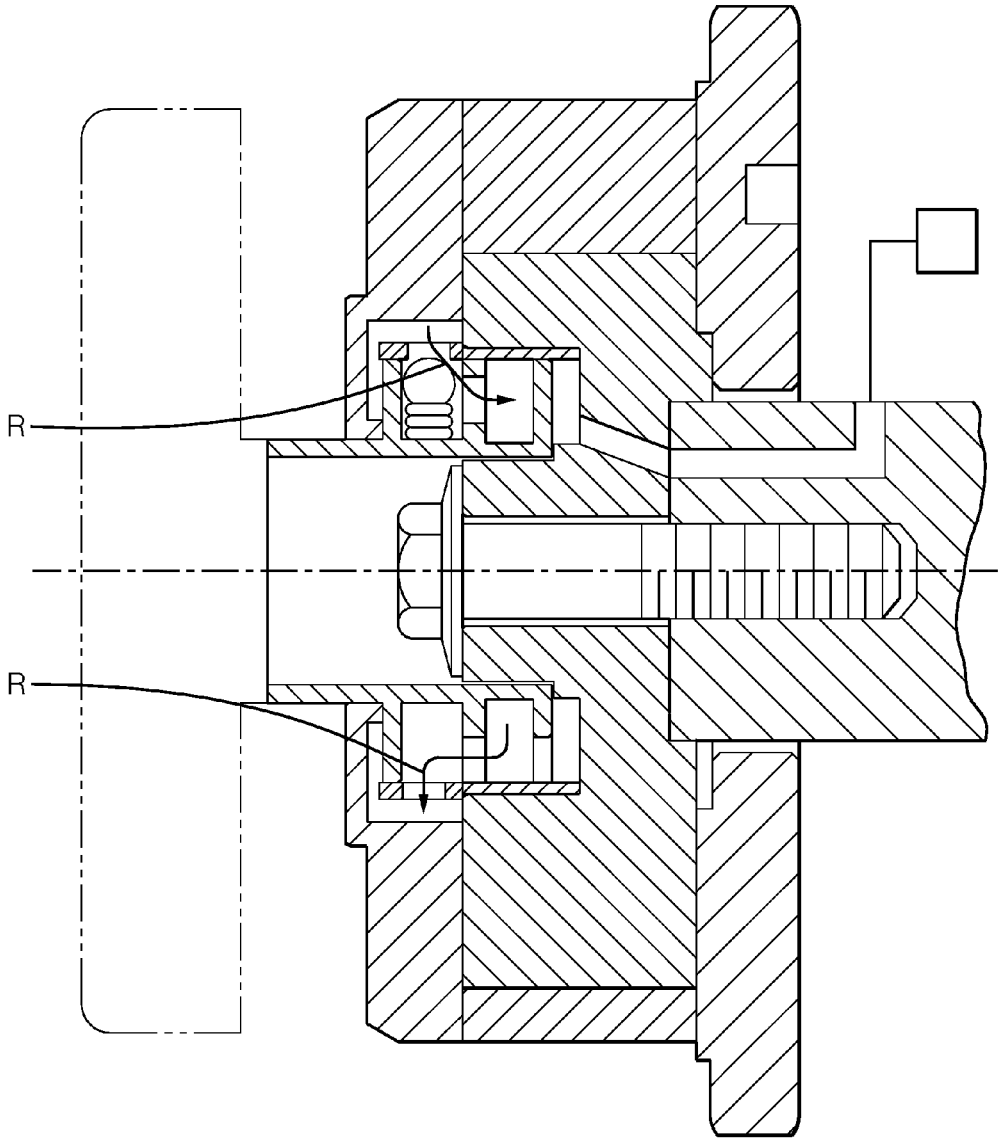
FIG. 5D is the axial cross-sectional view of FIG. 2 with reference numbers removed in order to clearly shown the path of oil flow as a result of the position of the valve spool as shown in FIG. 5A.
Figure 5E:
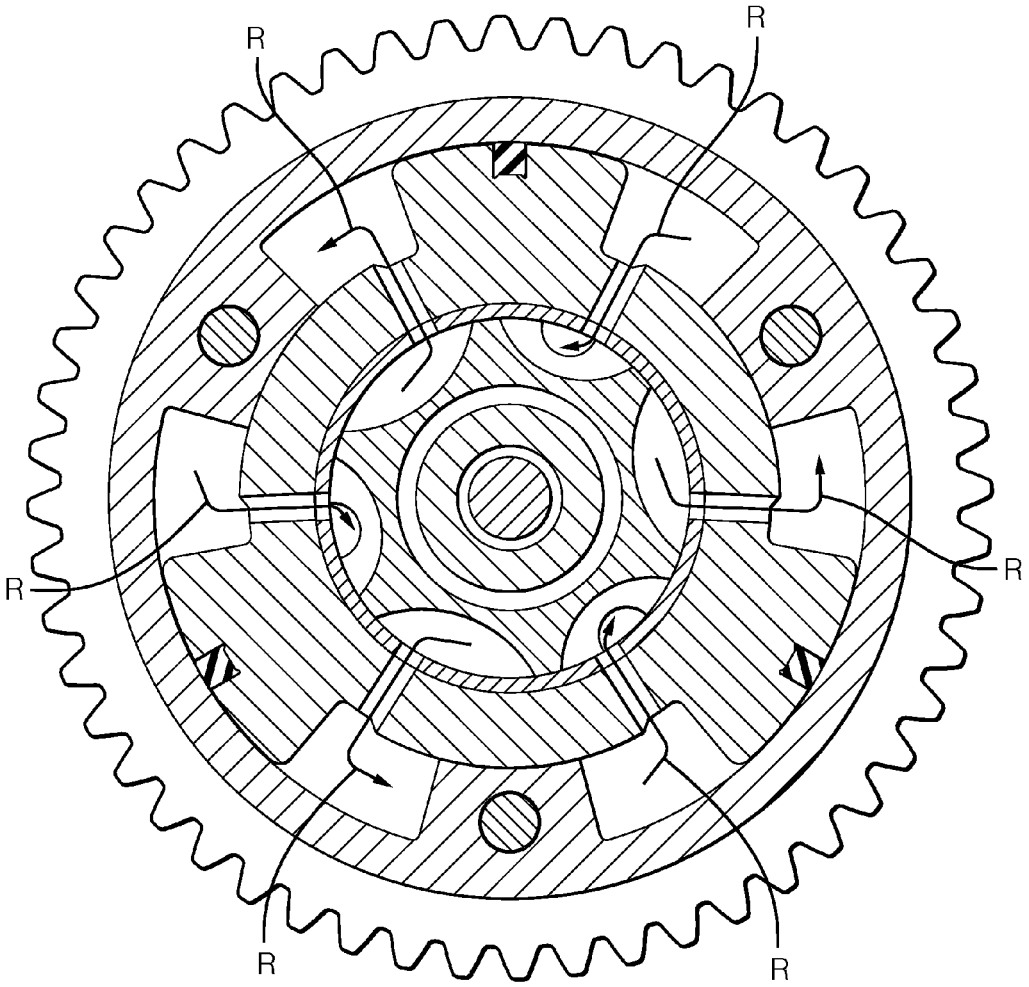
FIG. 5E is the radial cross-sectional view of FIG. 5A with reference numbers removed in order to clearly shown the path of oil flow as a result of the position of the valve spool as shown in FIG. 5A.
Figure 5F:
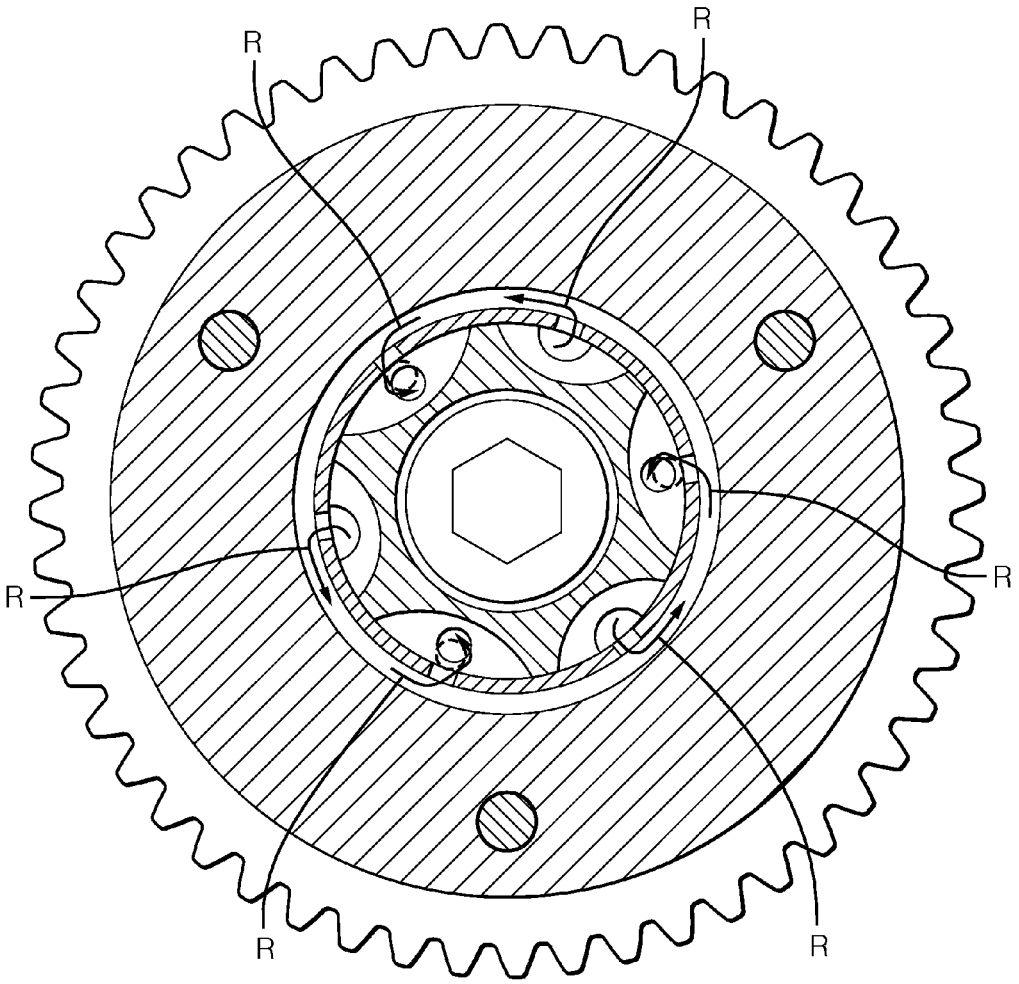
FIG. 5F is the radial cross-sectional view of FIG. 5B with reference numbers removed in order to clearly shown the path of oil flow as a result of the position of the valve spool as shown in FIG. 5A.

As shown in FIGS. 5A-5F, if a determination is made to advance the phase relationship between camshaft 14 and the crankshaft, it is necessary to rotate rotor 20 clockwise relative to stator 18 as viewed in the figures and as embodied by camshaft phaser 12. In order to rotate rotor 20 to the desired rotational position relative to stator 18, actuator 130 causes valve spool 28 to rotate clockwise relative to stator 18 to a rotational position of valve spool 28 relative to stator 18 that will also determine the rotational position of rotor 20 relative to stator 18. When valve spool 28 is rotated clockwise relative to stator 18, valve spool inner lands 94 are moved out of alignment with valve spool ring advance passages 134 and valve spool ring retard passages 136, thereby providing fluid communication between inner supply chambers 96 and retard chambers 44 and also between inner vent chambers 98 and advance chambers 42. Consequently, torque reversals of camshaft 14 which tend to pressurize oil within advance chambers 42 cause oil to be communicated from advance chambers 42 to retard chambers 44 via rotor advance passages 74, valve spool ring advance passages 134, inner vent chambers 98, vent chamber connecting passages 108, outer vent chambers 104, valve spool band vent passages 116, reservoir 112, valve spool band supply passages 114, outer supply chambers 102, supply chamber connecting passages 106, inner supply chambers 96, valve spool ring retard passages 136, and rotor retard passages 76. However, torque reversals of camshaft 14 which tend to pressurize oil within retard chambers 44 and apply a counterclockwise torque to rotor 20 are prevented from venting oil from retard chambers 44 because phasing check valves 78 prevent oil from flowing out of outer supply chambers 102 and being supplied to advance chambers 42. Oil continues to be supplied to retard chambers 44 from advance chambers 42 until rotor 20 is rotationally displaced sufficiently far for each valve spool inner land 94 to again align with respective valve spool ring advance passages 134 and valve spool ring retard passages 136 as shown in FIG. 5C, thereby again preventing fluid communication into and out of advance chambers 42 and retard chambers 44 and hydraulically locking the rotational position of rotor 20 relative to stator 18. In FIGS. 5D, 5E, and 5F, which are the same cross-sectional views of FIGS. 2, 5A, and 5B respectively, the reference numbers have been removed for clarity, and arrows R have been included to represent oil that is being recirculated for rotating rotor 20 relative to stator 18. It should be noted that FIGS. 5D and 5F show phasing check valves 78 being opened, but phasing check valves 78 may also be closed depending on the direction of the torque reversal of camshaft 14 at a particular time.

Figure 6A:
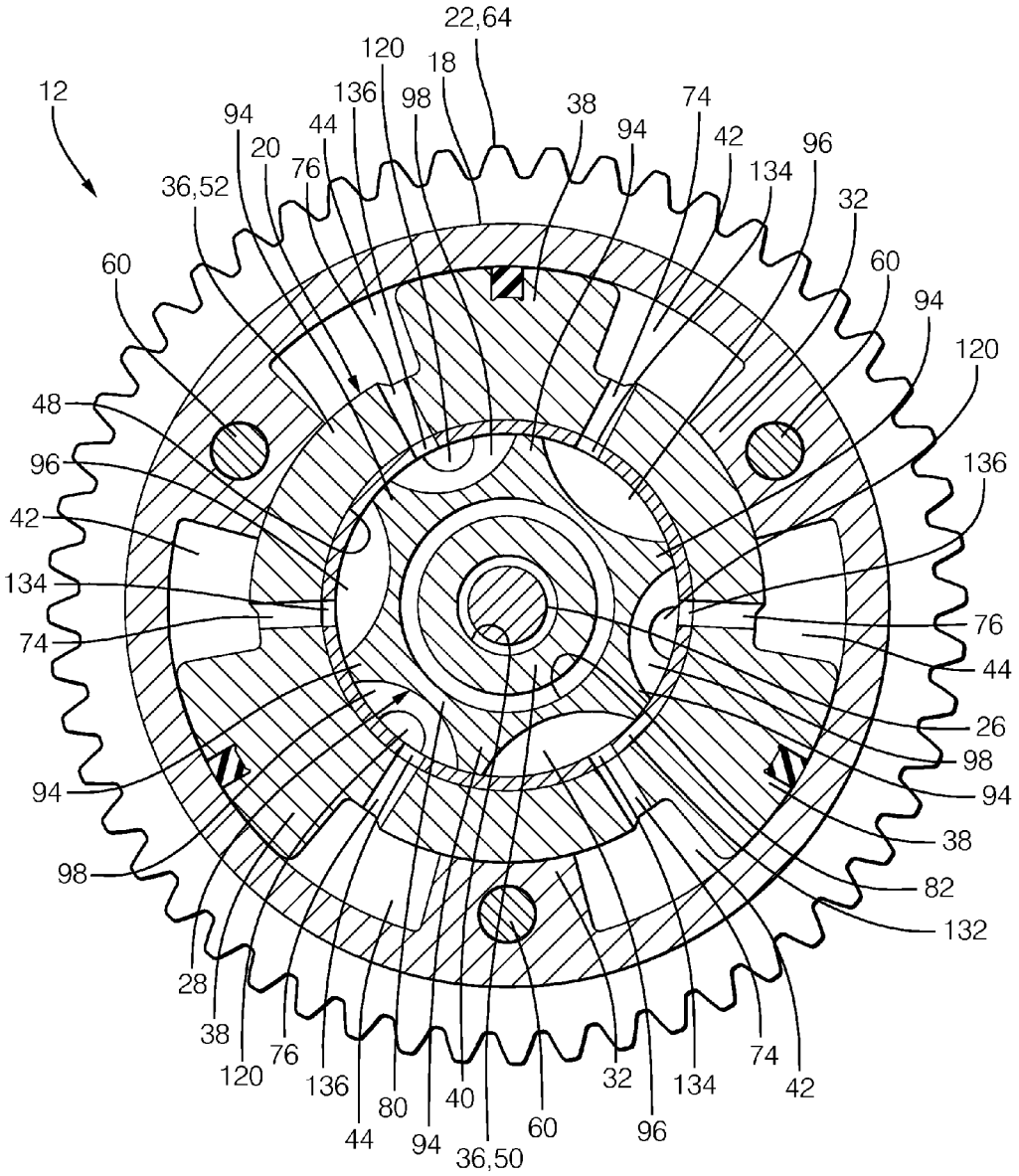
FIG. 6A is a radial cross-sectional view of the camshaft phaser taken through section line 3-3 of FIG. 2 showing the valve spool in a position which will result in a counterclockwise rotation of the rotor relative to the stator.
Figure 6B:
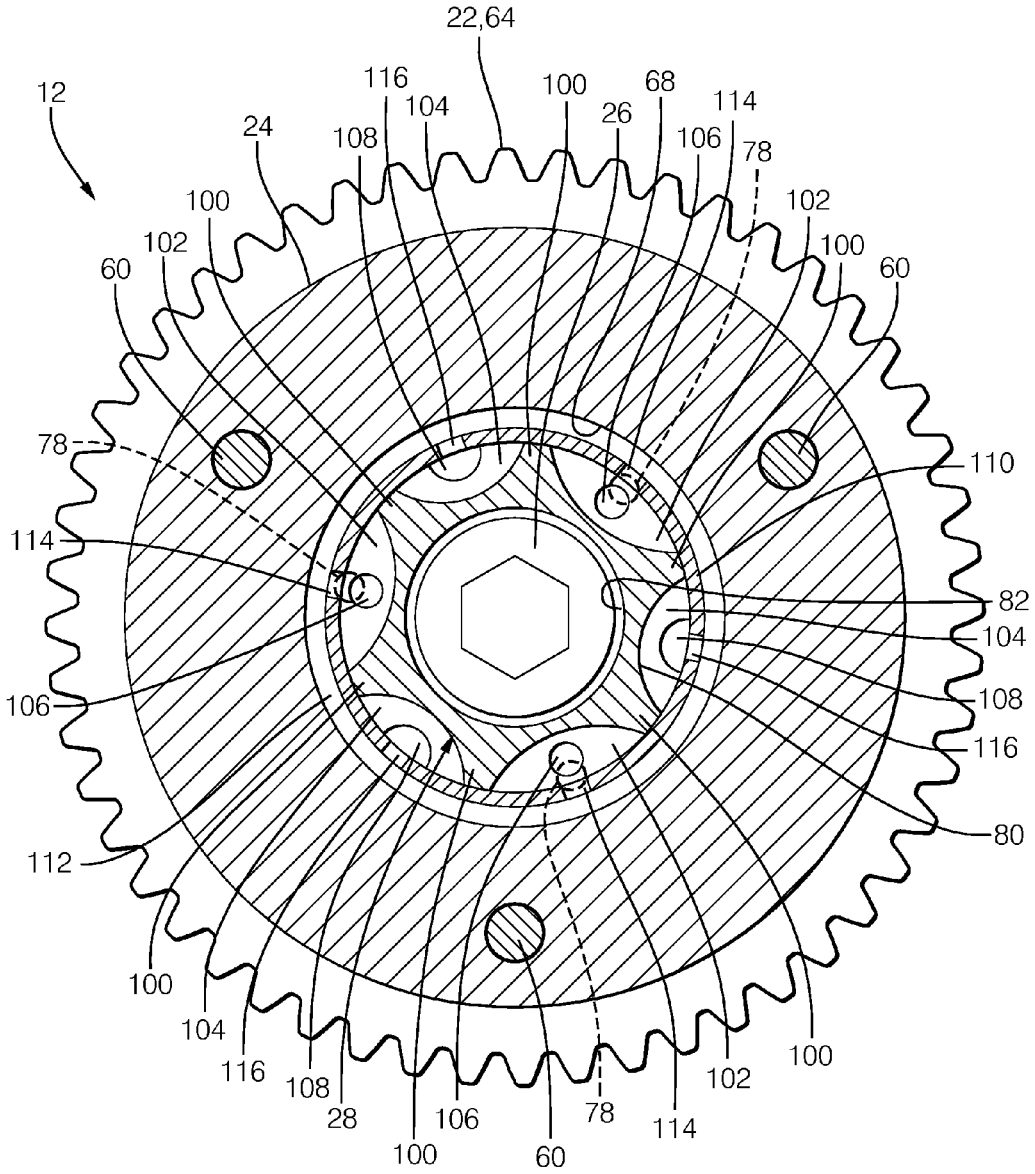
FIG. 6B is a radial cross-sectional view of the camshaft phaser taken through section line 4-4 of FIG. 2 showing the valve spool in the position of FIG. 6A.
Figure 6C:
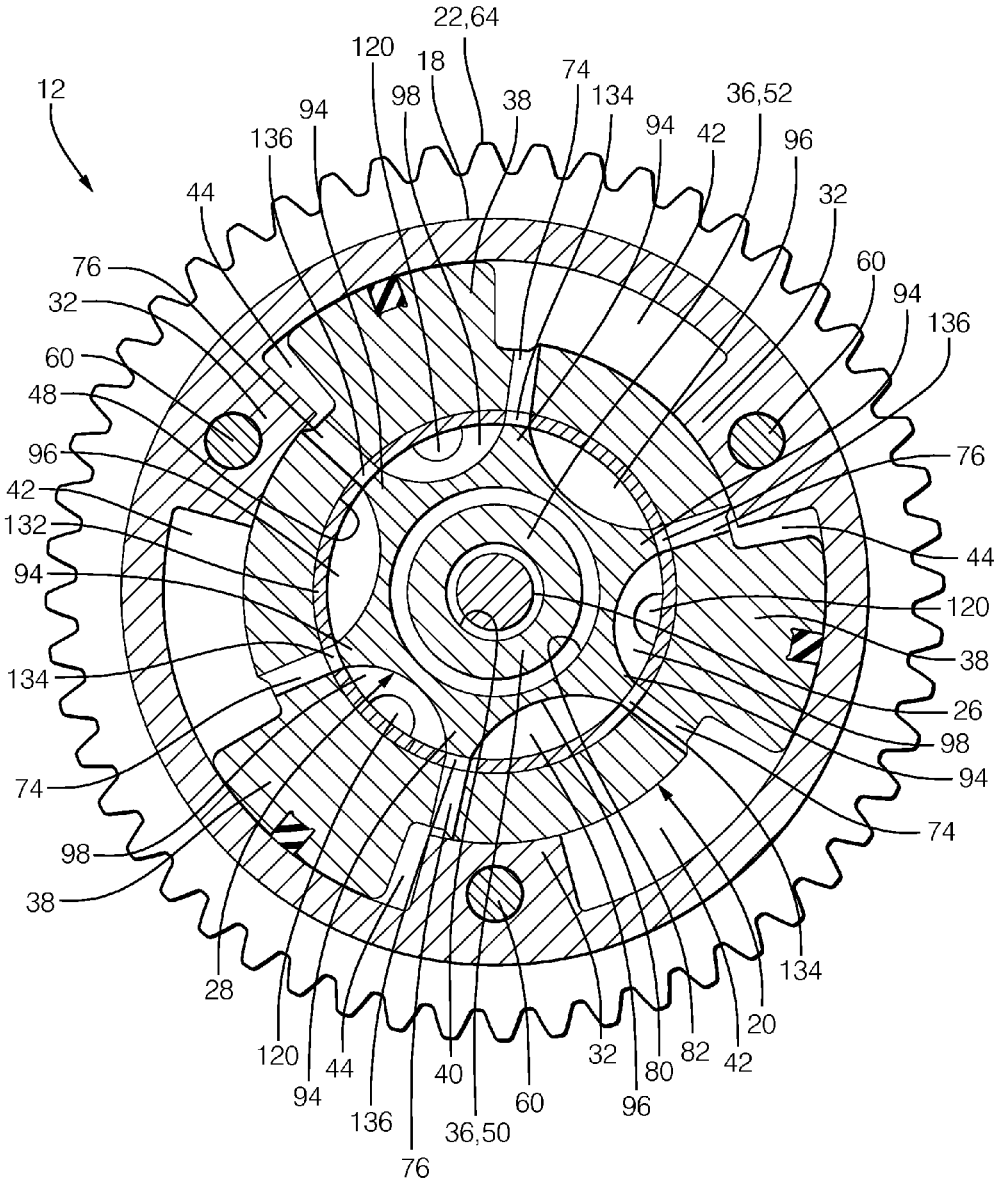
FIG. 6C is a radial cross-sectional view of the camshaft phaser taken through section line 3-3 of FIG. 2 showing the rotor after being rotated clockwise as a result of the position of the valve spool as shown in FIG. 6A.
Figure 6D:
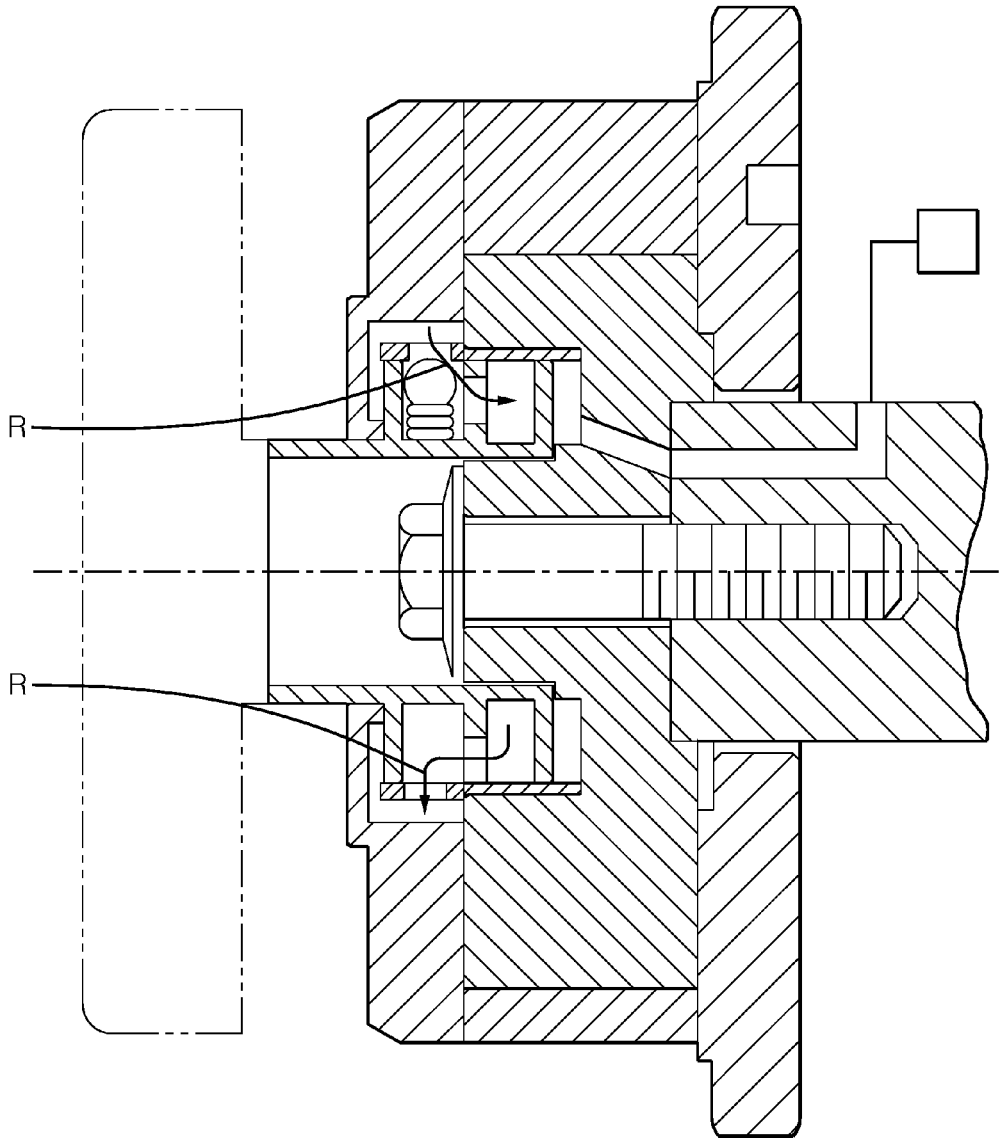
FIG. 6D is the axial cross-sectional view of FIG. 2 with reference numbers removed in order to clearly shown the path of oil flow as a result of the position of the valve spool as shown in FIG. 6A.
Figure 6E:
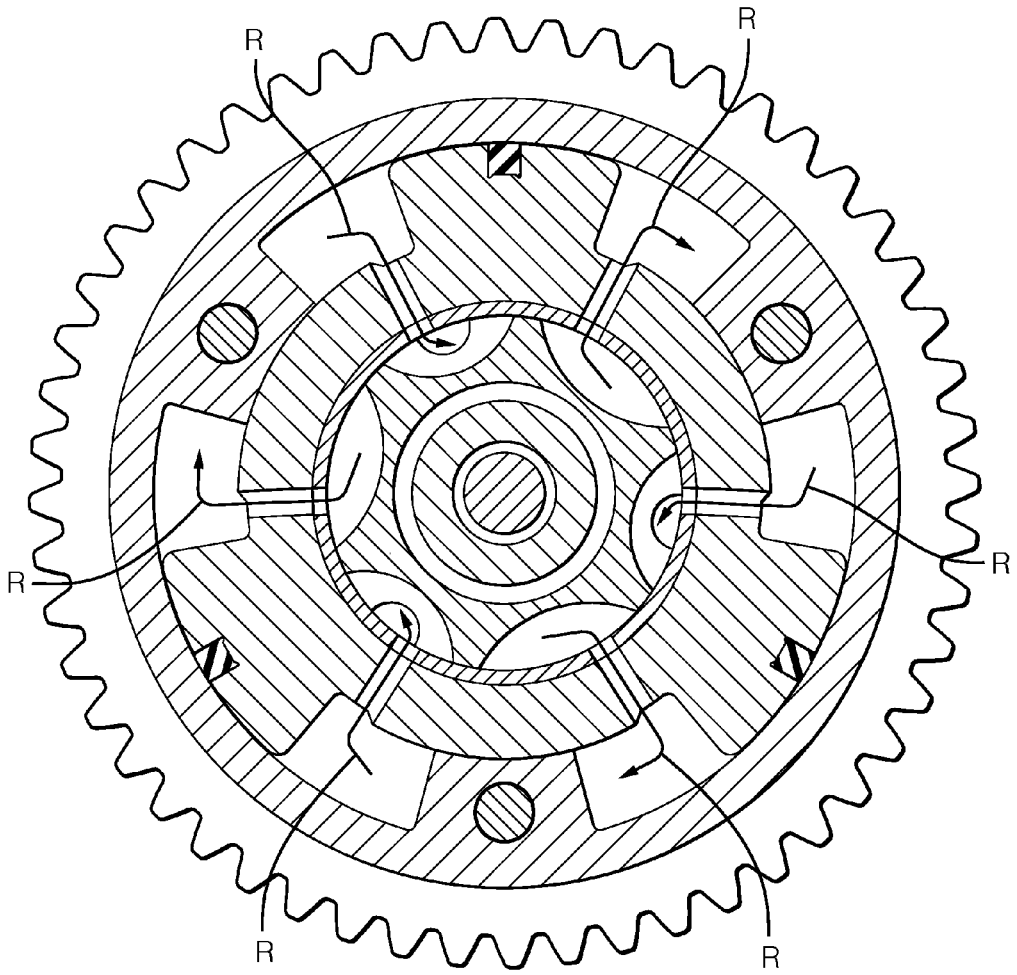
FIG. 6E is the radial cross-sectional view of FIG. 6A with reference numbers removed in order to clearly shown the path of oil flow as a result of the position of the valve spool as shown in FIG. 6A.
Figure 6F:
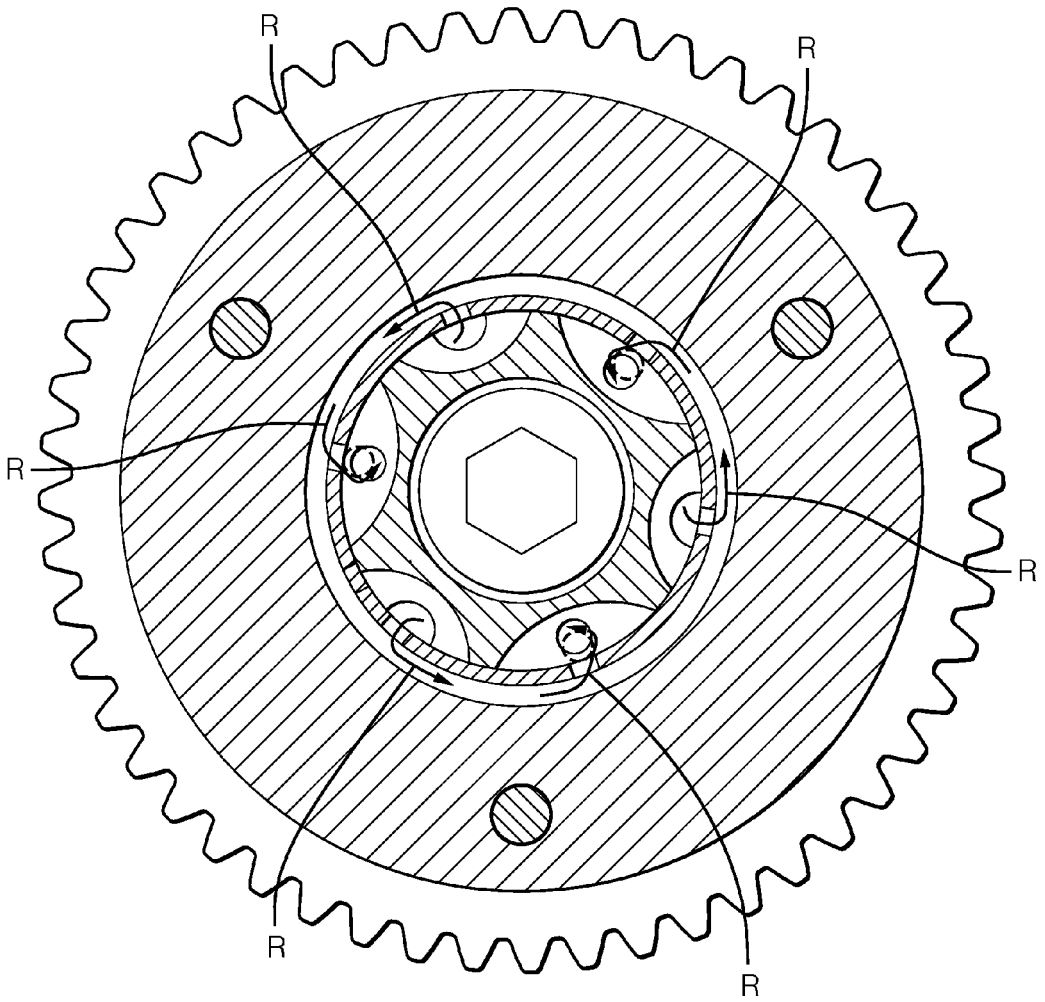
FIG. 6F is the radial cross-sectional view of FIG. 6B with reference numbers removed in order to clearly shown the path of oil flow as a result of the position of the valve spool as shown in FIG. 6A.

Conversely, as shown in FIGS. 6A-6F, if a determination is made to retard the phase relationship between camshaft 14 and the crankshaft, it is necessary to rotate rotor 20 counterclockwise relative to stator 18 as viewed in the figures and as embodied by camshaft phaser 12. In order to rotate rotor 20 to the desired rotational position relative to stator 18, actuator 130 causes valve spool 28 to rotate counterclockwise relative to stator 18 to a rotational position of valve spool 28 relative to stator 18 that will also determine the rotational position of rotor 20 relative to stator 18. When valve spool 28 is rotated counterclockwise relative to stator 18, valve spool inner lands 94 are moved out of alignment with valve spool ring advance passages 134 and valve spool ring retard passages 136, thereby providing fluid communication between inner supply chambers 96 and advance chambers 42 and also between inner vent chambers 98 and retard chambers 44. Consequently, torque reversals of camshaft 14 which tend to pressurize oil within retard chambers 44 cause oil to be communicated from retard chambers 44 to advance chambers 42 via rotor retard passages 76, valve spool ring retard passages 136, inner vent chambers 98, vent chamber connecting passages 108, outer vent chambers 104, valve spool band vent passages 116, reservoir 112, valve spool band supply passages 114, outer supply chambers 102, supply chamber connecting passages 106, inner supply chambers 96, valve spool ring advance passages 134, and rotor advance passages 74. However, torque reversals of camshaft 14 which tend to pressurize oil within advance chambers 42 and apply a clockwise torque to rotor 20 are prevented from venting oil from advance chambers 42 because phasing check valves 78 prevent oil from flowing out of outer supply chambers 102 and being supplied to retard chambers 44. Oil continues to be supplied to advance chambers 42 from retard chambers 44 until rotor 20 is rotationally displaced sufficiently far for each valve spool inner land 94 to again align with respective valve spool ring advance passages 134 and valve spool ring retard passages 136 as shown in FIG. 6C, thereby again preventing fluid communication into and out of advance chambers 42 and retard chambers 44 and hydraulically locking the rotational position of rotor 20 relative to stator 18. In FIGS. 6D, 6E, and 6F, which are the same cross-sectional views of FIGS. 2, 6A, and 6B respectively, the reference numbers have been removed for clarity, and arrows R have been included to represent oil that is being recirculated for rotating rotor 20 relative to stator 18. It should be noted that FIGS. 6D and 6F show phasing check valves 78 being opened, but phasing check valves 78 may also be closed depending on the direction of the torque reversal of camshaft 14 at a particular time.

It is important to note that oil exclusively flows from inner supply chambers 96 to whichever of advance chambers 42 and retard chambers 44 need to increase in volume in order to achieve the desired phase relationship of rotor 20 relative to stator 18 while oil exclusively flows to inner vent chambers 98 from whichever of advance chambers 42 and retard chambers 44 need to decrease in volume in order to achieve the desired phase relationship of rotor 20 relative to stator 18. In this way, only one set of phasing check valves 78 are needed acting in one direction within valve spool 28 in order to achieve the desired phase relationship of rotor 20 relative to stator 18. Consequently, it is not necessary to switch between sets of check valves operating in opposite flow directions or switch between an advancing circuit and a retarding circuit. In the case of the position control valve described herein, a unidirectional flow circuit is defined within valve spool 28 when valve spool 28 is moved to a position within rotor 20 to allow either flow from advance chambers 42 to retard chambers 44 or from retard chambers 44 to advance chambers 42 where the flow circuit prevents flow in the opposite directions. Consequently, the flow circuit is defined by valve spool 28 which is simple in construction and low cost to produce.

In operation, the actual rotational position of rotor 20 relative to stator 18 may drift over time from the desired rotational position of rotor 20 relative to stator 18, for example only, due to leakage from advance chambers 42 and/or retard chambers 44. Leakage from advance chambers 42 and/or retard chambers 44 may be the result of, by way of non-limiting example only, manufacturing tolerances or wear of the various components of camshaft phaser 12. An important benefit of valve spool 28 is that valve spool 28 allows for self-correction of the rotational position of rotor 20 relative to stator 18 if the rotational position of rotor 20 relative to stator 18 drifts from the desired rotational position of rotor 20 relative to stator 18. Since the rotational position of valve spool 28 relative to stator 18 is locked by actuator 130, valve spool ring advance passages 134 and valve spool ring retard passages 136 will be moved out of alignment with valve spool inner lands 94 when rotor 20 drifts relative to stator 18. Consequently, oil will flow to advance chambers 42 from retard chambers 44 and oil will flow from advance chambers 42 to retard chambers 44 as necessary to rotate rotor 20 relative to stator 18 to correct for the drift until each valve spool inner land 94 is again aligned with respective valve spool ring advance passages 134 and valve spool ring retard passages 136.

It should be noted that oil that may leak from camshaft phaser 12 is replenished from oil provided by oil source 124. Replenishing oil is accomplished by oil source 124 supplying oil to reservoir 112 via camshaft supply passage 129, rotor supply passage 126, annular volume 122, oil make-up passages 120, inner vent chambers 98, vent chamber connecting passages 108, outer vent chambers 104, and valve spool band vent passages 116. From reservoir 112, the oil may be supplied to advance chambers 42 or retard chambers 44 as necessary by one or more of the processes described previously for advancing, retarding, or correcting for drift.

It should be noted that opposing axial ends of valve spool 28 are at a common pressure because reservoir 112 and annular volume 122 are in constant fluid communication via oil make-up passages 120, inner vent chambers 98, vent chamber connecting passages 108, outer vent chambers 104, and valve spool band vent passages 116. Maintaining opposing axial ends of valve spool 28 at a common pressure prevents hydraulic pressure from applying an axial load to valve spool 28.

While camshaft phaser 12 has been described as including valve spool ring 132, it should now be understood that valve spool ring 132 may be omitted. If valve spool ring 132 is omitted, then valve spool inner lands 94 interface directly with the surface of annular valve spool recess 48 defined by rotor central hub outer portion 52. Furthermore, rotor advance passages 74 and rotor retard passages 76 need to be equal to the width of valve spool inner lands 94 when valve spool ring 132 is omitted, and the spacing between rotor advance passages 74 and rotor retard passages 76 matches the spacing between valve spool inner lands 94.

While phasing check valves 78 have been described in the embodiment herein as being located within outer supply chambers 102, it should now be understood that phasing check valves 78 could be located in numerous other locations which prevent flow from inner supply chambers 96 to inner vent chambers 98. By way of non-limiting example only, phasing check valves 78 could be located between reservoir 112 and outer vent chambers 104. In another configuration, outer supply chambers 102 may be commonly connected to a first common passage and outer vent chambers 104 may be commonly connected to a second common passage where one or more phasing check valves 78 allow flow from the second common passage to the first common passage while preventing flow from the first common passage to the second common passage.

While clockwise rotation of rotor 20 relative to stator 18 has been described as advancing camshaft 14 and counter-clockwise rotation of rotor 20 relative to stator 18 has been described as retarding camshaft 14, it should now be understood that this relationship may be reversed depending on whether camshaft phaser 12 is mounted to the front of internal combustion engine 10 (shown in the figures) or to the rear of internal combustion engine 10.

While this invention has been described in terms of preferred embodiments thereof, it is not intended to be so limited, but rather only to the extent set forth in the claims that follow.

We claim:

1. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining an advance chamber and a retard chamber with said input member;

a valve spool coaxially disposed within said output member such that said valve spool is rotatable relative to said output member and said input member, said valve spool defining a supply chamber and a vent chamber with said output member;

an actuator which rotates said valve spool in order to change the position of said output member relative to said input member by 1) supplying oil from said supply chamber to said advance chamber and venting oil from said retard chamber to said vent chamber when retarding the phase relationship of said camshaft relative to said crankshaft is desired and 2) supplying oil from said supply chamber to said retard chamber and venting oil from said advance chamber to said vent chamber when advancing the phase relationship between said camshaft relative to said crankshaft is desired; and a phasing check valve which allows oil to flow from said vent chamber to said supply chamber and prevents oil from flowing from said supply chamber to said vent chamber.

2. A camshaft phaser as in claim 1 wherein:

said vent chamber receives pressurized oil from said advance chamber when advancing the phase relationship of said camshaft relative to said crankshaft; and said vent chamber receives pressurized oil from said retard chamber when retarding the phase relationship of said camshaft relative to said crankshaft.

3. A camshaft phaser as in claim 1 wherein:

said input member is a stator having a plurality of lobes;

said output member is a rotor coaxially disposed within said stator, said rotor having a plurality of vanes interspersed with said plurality of lobes;

said advance chamber is one of a plurality of advance chambers defined by said plurality of vanes and said plurality of lobes; and said retard chamber is one of a plurality of retard chambers defined by said plurality of vanes and said plurality of lobes.

4. A camshaft phaser as in claim 3 wherein said supply chamber is one of a plurality of supply chambers defined with said rotor and said vent chamber is one of a plurality of vent chambers defined with said rotor such that said plurality of supply chambers are arranged in an alternating pattern with said plurality of vent chambers.

5. A camshaft phaser as in claim 4 wherein said phasing check valve is one of a plurality of phasing check valves where said plurality of phasing check valves allows oil to flow from said plurality of vent chambers to said plurality of supply chambers and prevent oil from flowing from said plurality of supply chambers to said plurality of vent chambers.

6. A camshaft phaser as in claim 5 wherein said rotor includes a rotor central hub from which said plurality of vanes extend radially outward therefrom, said rotor central hub having a rotor central through bore extending axially therethrough.

7. A camshaft phaser as in claim 6 wherein:

said rotor central hub defines an annular valve spool recess coaxially therein such that said annular valve spool recess divides said rotor central hub into a rotor central hub inner portion and a rotor central hub outer portion; and said valve spool is rotatably located coaxially within said annular valve spool recess.

8. A camshaft phaser as in claim 7 wherein:

said valve spool includes a spool central hub with a spool central through bore extending coaxially therethrough; and said spool central through bore is sized to mate with said rotor central hub inner portion in a close sliding interface such that said valve spool is able to freely rotate on said rotor central hub inner portion while substantially preventing oil from passing between the interface of said spool central through bore and said rotor central hub inner portion.

9. A camshaft phaser as in claim 8 where a plurality valve spool lands are circumferentially spaced and extend radially outward from said spool central hub such that said plurality of supply chambers and said plurality of vent chambers are separated by said plurality of valve spool lands.

10. A camshaft phaser as in claim 9 wherein said plurality of valve spool lands selectively prevent fluid communication between 1) said plurality of supply chambers and said plurality of advance chambers, 2) said plurality vent chambers and said plurality of advance chambers, 3) said plurality of supply chambers and said plurality of retard chambers, and 4) said plurality of vent chambers and said plurality of retard chambers.

11. A camshaft phaser as in claim 8 wherein said camshaft phaser further comprises:

a back cover closing one axial end of said stator;

a front cover closing the other axial end of said stator such that said plurality of advance chambers and said plurality of retard chambers are defined axially between said back cover and said front cover, said front cover having a front cover central bore extending coaxially therethrough;

wherein said valve spool is captured axially between said annular valve spool recess and said front cover.

12. A camshaft phaser as in claim 11 wherein:

a reservoir is defined between said valve spool and said front cover; and oil communicated to said plurality of supply chambers from said plurality of vent chambers passes through said reservoir.

13. A camshaft phaser as in claim 6 further comprising a camshaft phaser attachment bolt extending coaxially through said rotor central through bore for clamping said rotor to said camshaft, wherein said valve spool radially surrounds said camshaft phaser attachment bolt.

14. A camshaft phaser as in claim 4 wherein:

a hold position of said valve spool relative to said rotor blocks fluid communication between said plurality of supply chambers and said plurality of advance chambers and said plurality of retard chambers and also blocks fluid communication between said plurality of vent chambers and said plurality of advance chambers and said plurality of retard chambers, thereby preventing rotation of said rotor relative to said stator;

clockwise rotation of said valve spool relative to said stator causes said rotor to rotate clockwise relative to said stator and clockwise relative to said valve spool by opening passages between said plurality of supply chambers and said plurality of advance chambers or said plurality of retard chambers and by opening passages between said plurality of vent chambers and 1) said plurality of advance chambers if said plurality of supply chambers are opened to said plurality of retard chambers and 2) said plurality of retard chambers if said plurality of supply chambers are opened to said plurality of advance chambers until said rotor is in said hold position relative to said valve spool; and counterclockwise rotation of said valve spool relative to said stator causes said rotor to rotate counterclockwise relative to said stator and counterclockwise relative to said valve spool by opening passages between said plurality of supply chambers and the other of said plurality of advance chambers said plurality of retard chambers and by opening passages between said plurality of vent chambers and 1) said plurality of advance chambers if said plurality of supply chambers are opened to said plurality of retard chambers and 2) said plurality of retard chambers if said plurality of supply chambers are opened to said plurality of advance chambers until said rotor is in said hold position relative to said valve spool.

15. A camshaft phaser as in claim 5 wherein:

a hold position of said valve spool relative to said rotor blocks fluid communication between said plurality of supply chambers and said plurality of advance chambers and said plurality of retard chambers and also blocks fluid communication between said plurality of vent chambers and said plurality of advance chambers and said plurality of retard chambers, thereby preventing rotation of said rotor relative to said stator;

clockwise rotation of said valve spool relative to said stator causes passages to open between said plurality of advance chambers and said plurality of retard chambers such that said plurality of phasing check valves permit oil flow between said plurality of advance chambers and said plurality of retard chambers to cause said rotor to rotate clockwise relative to said stator and clockwise relative to said valve spool and such that said plurality of phasing check valves prevent oil flow between said plurality of advance chambers and said plurality of retard chambers to prevent counterclockwise rotation of said rotor relative to said stator; and counterclockwise rotation of said valve spool relative to said stator causes passages to open between said plurality of advance chambers and said plurality of retard chambers such that said plurality of phasing check valves permit oil flow between said plurality of advance chambers and said plurality of retard chambers to cause said rotor to rotate counterclockwise relative to said stator and counterclockwise relative to said valve spool and such that said plurality of phasing check valves prevent oil flow between said plurality of advance chambers and said plurality of retard chambers to prevent clockwise rotation of said rotor relative to said stator.

16. A camshaft phaser as in claim 15 wherein:

clockwise rotation of said valve spool relative to said stator causes said rotor to rotate clockwise relative to said stator and clockwise relative to said valve spool until said rotor is in said hold position relative to said valve spool; and counterclockwise rotation of said valve spool relative to said stator causes said rotor to rotate counterclockwise relative to said stator and counterclockwise relative to said valve spool until said rotor is in said hold position relative to said valve spool.

17. A camshaft phaser as in claim 1 wherein axial movement of said valve spool relative to said output member is substantially prevented.

18. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft about an axis;

a rotor coaxially disposed within said stator, said rotor having a plurality of vanes interspersed with said plurality of lobes defining a plurality of alternating advance chambers and retard chambers;

a valve spool coaxially disposed within said rotor such that said valve spool is rotatable relative to said rotor and said stator, said valve spool defining a plurality of alternating supply chambers and vent chambers with said rotor;

an actuator which rotates said valve spool in order to change the rotational position of said rotor relative to said stator by 1) supplying pressurized oil from said plurality of supply chambers to said plurality of advance chambers and venting oil from said plurality of retard chambers to said plurality of vent chambers when retarding the phase relationship of said camshaft relative to said crankshaft is desired and 2) supplying pressurized oil from said plurality of supply chambers to said plurality of retard chambers and venting oil from said plurality of advance chambers to said plurality of vent chambers when advancing the phase relationship between said camshaft relative to said crankshaft is desired; and a plurality of phasing check valves which allow oil to flow from said plurality of vent chambers to said plurality of supply chambers and prevent oil from flowing from said plurality of supply chambers to said plurality of vent chambers.

19. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft about an axis;

a rotor coaxially disposed within said stator, said rotor having a plurality of vanes interspersed with said plurality of lobes defining a plurality of alternating advance chambers and retard chambers;

a valve spool coaxially disposed within said rotor such that said valve spool is rotatable relative to said rotor and said stator, said valve spool defining a plurality of alternating supply chambers and vent chambers with said rotor;

an actuator which rotates said valve spool in order to change the rotational position of said rotor relative to said stator by 1) supplying pressurized oil from said plurality of supply chambers to said plurality of advance chambers and venting oil from said plurality of retard chambers to said plurality of vent chambers, as a result of torque reversals applied to said camshaft, when retarding the phase relationship of said camshaft relative to said crankshaft is desired and 2) supplying pressurized oil from said plurality of supply chambers to said plurality of retard chambers and venting oil from said plurality of advance chambers to said plurality of vent chambers, as a result of torque reversals applied to said camshaft, when advancing the phase relationship between said camshaft relative to said crankshaft is desired; and a plurality of phasing check valves which allow oil to flow from said plurality of vent chambers to said plurality of supply chambers and prevent oil from flowing from said plurality of supply chambers to said plurality of vent chambers.

* * * * *